US006279471B1

(12) United States Patent
Reddoch

(10) Patent No.: US 6,279,471 B1
(45) Date of Patent: Aug. 28, 2001

(54) DRILLING FLUID RECOVERY DEFLUIDIZATION SYSTEM

(76) Inventor: Jeffrey Reddoch, P.O. Box 82098, Lafayette, LA (US) 70598-2098

( * ) Notice: Subject to any disclaimer, the term of this patent is extended or adjusted under 35 U.S.C. 154(b) by 0 days.

(21) Appl. No.: 09/454,081

(22) Filed: Dec. 3, 1999

Related U.S. Application Data

(63) Continuation-in-part of application No. 08/713,604, filed on Sep. 13, 1996, now Pat. No. 5,996,484.
(60) Provisional application No. 60/003,781, filed on Sep. 15, 1995.

(51) Int. Cl.[7] ..... B30B 9/14
(52) U.S. Cl. ..... 100/37; 100/71; 100/106; 100/127; 100/131; 100/148; 100/191; 175/66
(58) Field of Search ..... 100/37, 71–75, 100/90–91, 106, 112, 117, 126–129, 131, 132, 134, 147, 148, 191, 192; 175/66, 206, 207

(56) References Cited

U.S. PATENT DOCUMENTS

| | | | | |
|---|---|---|---|---|
| 751,752 | * | 2/1904 | Pilliod | 100/191 |
| 1,182,306 | * | 5/1916 | Overton | 100/192 |
| 1,312,811 | * | 8/1919 | Sizer | 100/106 |
| 1,772,262 | * | 8/1930 | Naugle | 100/148 |
| 1,838,996 | * | 12/1931 | Lang | 100/37 |
| 2,994,105 | * | 8/1961 | Seal et al. | 100/37 |
| 3,111,082 | * | 11/1963 | Larson et al. | 100/147 |
| 3,230,865 | * | 1/1966 | Hibbel et al. | 100/37 |
| 3,590,730 | * | 7/1971 | Heinrich | 100/148 |
| 3,938,434 | * | 2/1976 | Cox | 100/90 |
| 4,002,559 | * | 1/1977 | Paterson et al. | 209/3 |
| 4,242,146 | * | 12/1980 | Kelly, Jr. | 175/66 |
| 4,411,074 | | 10/1983 | Daly . | |
| 4,546,783 | * | 10/1985 | Lott | 175/66 |
| 4,709,628 | * | 12/1987 | Glowacki | 100/117 |
| 4,871,449 | * | 10/1989 | Lott | 100/112 |
| 5,009,795 | * | 4/1991 | Eichler | 100/117 |
| 5,129,468 | * | 7/1992 | Parmenter | 175/66 |
| 5,137,489 | * | 8/1992 | Boster | 100/121 |
| 5,160,441 | * | 11/1992 | Lundquist | 210/781 |
| 5,173,196 | * | 12/1992 | Macrae | 100/90 |
| 5,205,930 | * | 4/1993 | Obrestad | 100/117 |
| 5,303,786 | * | 4/1994 | Prestridge et al. | 175/66 |
| 5,330,017 | * | 7/1994 | Hart et al. | 175/66 |
| 5,357,855 | * | 10/1994 | Ishigaki et al. | 100/117 |
| 5,361,998 | * | 11/1994 | Sirevag et al. | 241/79.1 |

* cited by examiner

*Primary Examiner*—Peter Vo
*Assistant Examiner*—Louis K. Huynh
(74) *Attorney, Agent, or Firm*—Robert N. Montgomery

(57) ABSTRACT

A press process and structure is disclosed for defluidizing earth drill cuttings, thereby extracting valuable drilling additives and returning them to the drilling system while producing a dense, drier material which may be chemically treated for distillation and/or better dissolution into the environment, thereby reducing, cost in transportation and environmental treatment chemicals thus reducing environmental contamination.

3 Claims, 13 Drawing Sheets

DRILLING FLUID RECOVERY DEFLUIDIZATION SYSTEM

This is a continuation-in-part of previous application 08/713,604 filed Sep. 13, 1996 now issued as U.S. Pat. No. 5,996,484, and also claims benefit of provisional 60/003,781 filed Sep. 15, 1995.

BACKGROUND OF THE INVENTION

1. Field of the Invention

The field of the present invention relates generally to the recovery of drilling fluids from discharge cuttings fluids from a drilling/production operation, more particularly, a method utilizing various types of presses for the recovery of such drilling fluids through compaction and defluidization of entrained solids in a cuttings slurry prior to such cuttings being injected into a well casing or in conjunction with other environmental distribution and/or disposal operations.

2. General Background

In oil well drilling operations, drilling fluid containing additives is circulated downwardly through the drill string to lubricate and remove cuttings from the bit. A mixture containing drilling fluid and cuttings is then returned to the surface through and annulus around the drill pipe "Adherent drilling fluid" is defined as drilling fluid adhering to the drill cuttings, and, if the drilling fluid is oil-based, the adherent drilling fluid also includes oil.

It is well known that the drill cuttings must be separated from the drilling fluid so that the drilling fluid can be recirculated. Additionally, solid cuttings generated in a drilling process, such as during exploration for oil or gas, which have been contaminated with adherent drilling fluid must be cleansed to remove surface contaminates prior to discharge of the cuttings to the environment. Several such methods and apparatus are disclosed by U.S. Pat. Nos. 5,361,998, 5,303786, 5,129,468, and 4,546,783. Such apparatus are particularly beneficial in laundering or cleansing of drill cuttings on offshore drill platforms so that the drill cuttings are environmentally safe for discharge into the sea. However, the loss of a portion of the adherent fluids is inevitable and is becoming more of a concern.

Many of the problems associated with drilling fluid recovery for onshore operations are expressed by Hart in U.S. Pat. No. 5,330,017. Hart suggests that, due to environmental concerns, much of the slurry is transported in a fluid or semi-fluid state to approved disposal sites. Such sites utilize deep wells whereby hazardous waste can be injected back into the earth or mixed with chemicals such as lye and fly ash which render the materials acceptable for land reclamation. Disposal sites may also provide centrifuges as a means of defluidizing the slurry and rely heavily on polymers added to the effluent to render the discharge liquids safe for reintroduction into the environment.

Many recovery and treatment apparatus utilize separate cells having low speed agitators to stir a mixture of cutting and cleansing solution called surfactants. The cuttings are transferred from one cell to the next where additional agitation and cleansing take place. Thereafter, a slurry of cleansed drill cuttings and surfactant is pumped from the cells to a vibrating screen operation whereby most of the surfactant is removed and sent back to the system. In some cases a portion of the surfactant solution, which is rich in fine drill cuttings and adherent drilling fluids, is run through one or more hydrocyclone separators which discharge the fine drill cuttings in solution separated from the larger, cleansed drill cuttings. However, it has been the practice in the past to simply pass the cuttings over one or more vibrating screens to recover the majority of the drilling additives and discharge the remainder as waste material. In any case, it is the overflow and underflow of such discharge slurries comprising surfactant solution, drilling fluid, and entrained fine drill cuttings which is the focus element of the present invention. As discussed by Lott in U.S. Pat. No. 4,546,783, hydrocyclones used in the recovery system tend to lose 4% of the surfactant solution alone in the process, which is environmentally and economically undesirable. An even greater percentage of drilling fluids are also lost in the process. Lott further suggested a process and apparatus for recovering more of the surfactant. However, Lott's use of a vacuum chamber and a drag link conveyer to clear additional shaker screens, the use of a second hydrocyclone, gas spargers and liquid spray nozzles to induce the entrained solids to rise to the surface in yet another decanter so that they can be drained off into a second decanter prior to disposal, seems to be an over-complication of the process. However, such drastic measures to recover only 4% of the surfactant, along with the drilling fluids, is indicative of the need for a more efficient method of recovery.

Although screw presses have been widely used in the agricultural industry to dewater fibrous slurries, such presses have not gained acceptance in the earth drilling industry for a number of reasons. Compressing earth cuttings developed from drilling operations would be difficult under most conditions, due to the volume, the abrasiveness, and non-uniformity of such materials. Dewatering screw conveyors and screen conveyor systems have been used with some success in mining operations to remove a large portion of the residual water. However, the drilling additives associated with petroleum drilling operations make defluidizing more complicated. It has been found that screw presses, such as disclosed by Eichler in U.S. Pat. No. 5,009,795, could serve as the basis for a defluidizing press in the present invention concept. However, due to the nature of the materials handled, abrasiveness, and the material's lack of compressibility, a more robust screw flighting and a much finer screen are required. A means of controlling the flow of material to form compaction is also required which will not restrict the material discharge. It is also known, according to Gloacki's U.S. Pat. No. 4,709,628, that a variable damper having a conical shape can be used to control the material discharge of such screw presses. However, Glowacki uses a plurality of flaps, which would become compacted or misshaped and impair the flow of heavy non-compressible materials such as earth cuttings. Therefore, a more rigid conical or elliptical shape would be more practical. It has therefore been found that a defluidizing type press designed specifically to handle a slurry of drill cuttings may be utilized to recover drilling fluids while defluidizing the discharge cuttings, thereby resulting in a savings of costly drilling additives and reducing the volume of discharge into the environment. Such savings are further enhanced as a result of a reduction in environmental additives, such as lime and fly ash, and other such chemicals used to neutralize the discharge waste material when being reintroduced into the environment. By defluidizing the discharge slurry, the volume of disposable material is reduced. Therefore, less chemicals are required to treat the material before introduction into the environment

SUMMARY OF THE PRESENT INVENTION

The present invention provides a means of recovery of drilling fluids from drilling fluid slurries containing entrained solids. Such slurries are derived directly from the cascading, vibrating screens in various drill cutting processing systems. It has been found that any discharge from such systems which is considered suitable for disposal into the environment can now be cycled through a defluidizing press whereby up to 40% by volume of the remaining drilling fluids can be recovered in the defluidization process. A second defluidizing press may be used to further reduce the fluid content, thereby reducing the discharge volume. Several embodiments are disclosed which further define the process under various conditions. In addition, several types of defluidizing presses are disclosed which may prove applicable under various circumstances. It is anticipated that such defluidizing presses may be capable of replacing all or a significant part of the current processes, thus eliminating the cascading screens, hydrocyclones, and centrifuges. It should be understood that although the majority of the fluids from the cuttings are being recovered by utilizing the screw press and liquid screen as taught herein, the solids still retain a relatively high moisture content and still retain some petrochemicals. It is also desirable, in some cases, to reduce the solids to their lowest possible mass for transport and disposal into the environment. Therefore, systems also may be provided that utilize the defluidizing technology that allows the defluidized cuttings to be further processed for transport and disposal in the environment. Such systems may simply include further treatment of the defluidized cuttings with chemicals to disperse the petrochemicals and assist in the biodegradation of the solids prior to reintroduction into the environment. Other more elaborate systems as taught herein also utilize the combustible petrochemical in the cuttings to assist in drying the solids prior to mixing environmentally enhancing chemicals.

Defluidized cuttings may be disposed of in any number of ways as disclosed herein, such as reinduction into well casing, transported, at a reduced volume cost, for injection at processing and disposal sites, or to distillation and land reclamation farms where fewer chemicals will be required to treat the materials prior to introduction into the environment.

It is, therefore, an object of the present invention to provide a means of recovery of a greater percentage of drilling fluids currently being lost in the disposition process.

Another object is to make the use of synthetic drilling additives more economical to use due to the recovery process.

Still another object of the invention is to reduce the quantity of fluids being transported for disposition, thereby making transport of disposable drill cuttings more economical.

Yet another object of the present invention is to reduce the drilling additives in the disposable cuttings, thereby reducing the quantity of biodegradation additives generally required by land farms.

This summary is a concise description of the use of a press system to recover expensive drilling fluid additives and a method for achieving the objectives stated and is not intended to limit or modify the scope of the invention as stated in the claims as follows.

BRIEF DESCRIPTION OF THE DRAWINGS

For a further understanding of the nature and objects of the present invention, reference should be made to following detailed description taken in conjunction with the accompanying drawings, in which like parts are given like reference numerals, and wherein.

DETAILED DESCRIPTION OF THE PREFERRED EMBODIMENT

Figure 1:
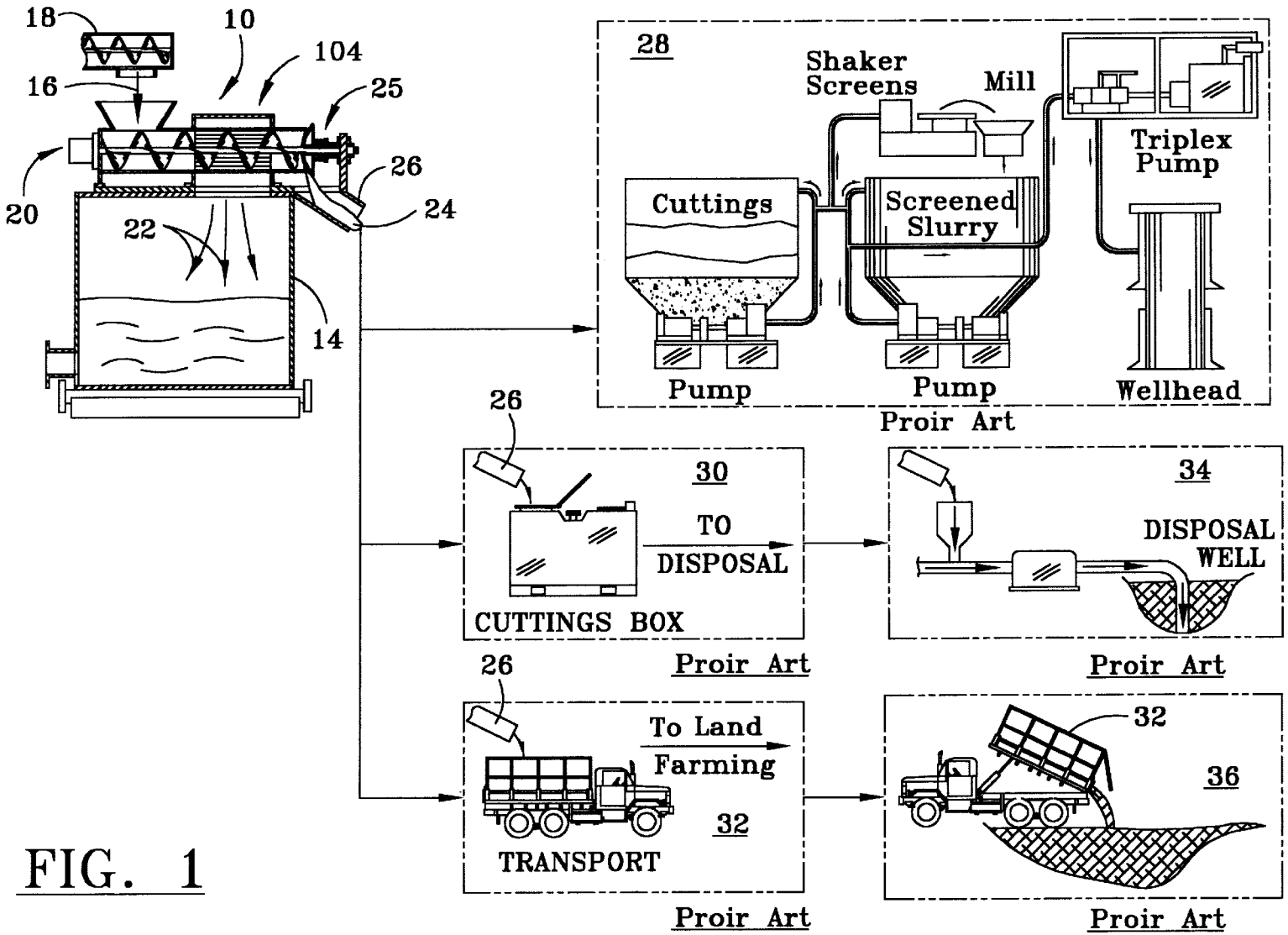
FIG. 1 is a diagram of the present invention in section view shown receiving slurry from a shaker screen system and discharging defluidized material to a well injection system, to cutting box for disposal at a hazardous waste site, or to a truck for disposition into a distillation process or the environment.
Figure 2:
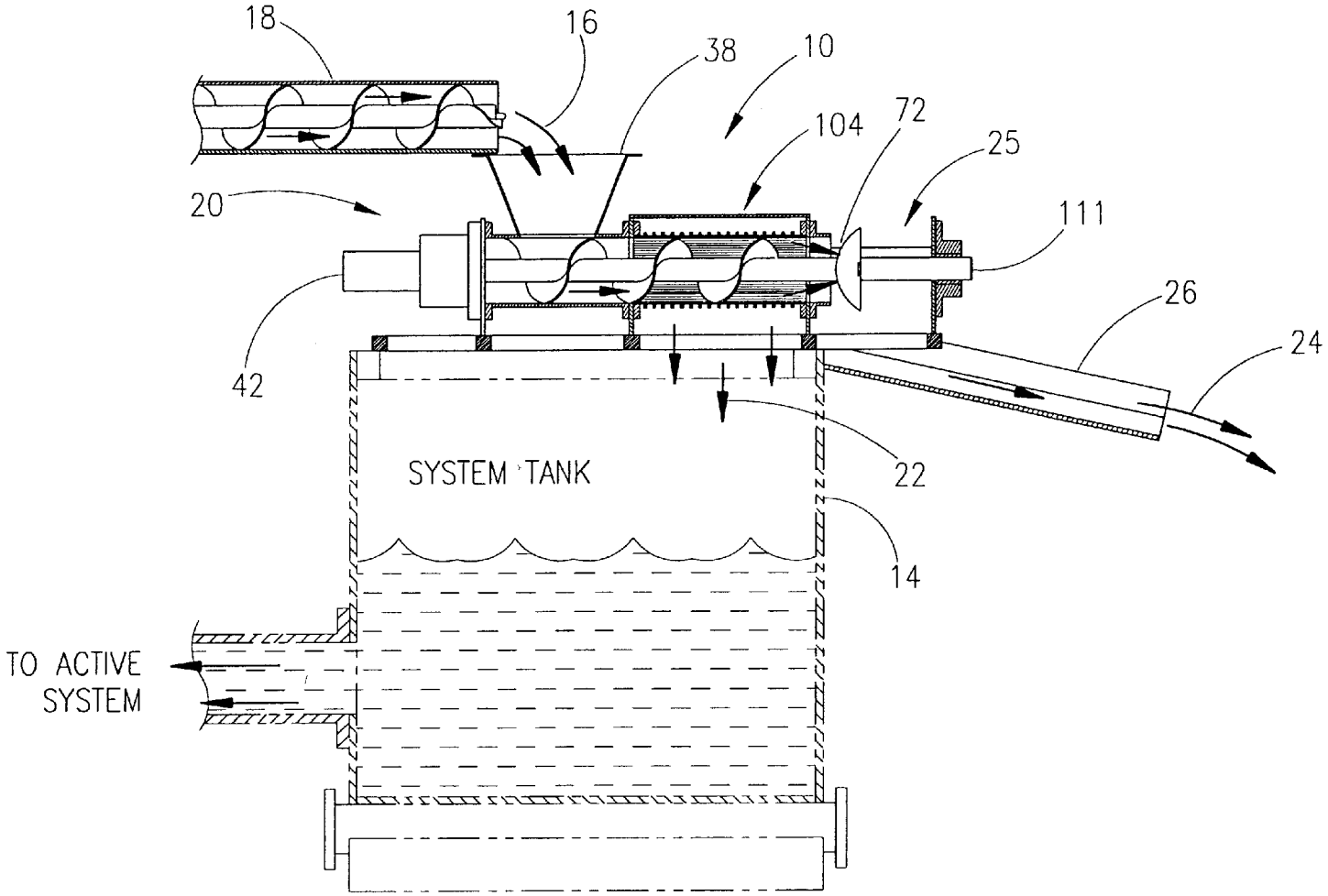
FIG. 2 is a partial cross section view of a system tank and the present invention mounted thereto, showing slurry material being discharged into a hopper.
Figure 3:
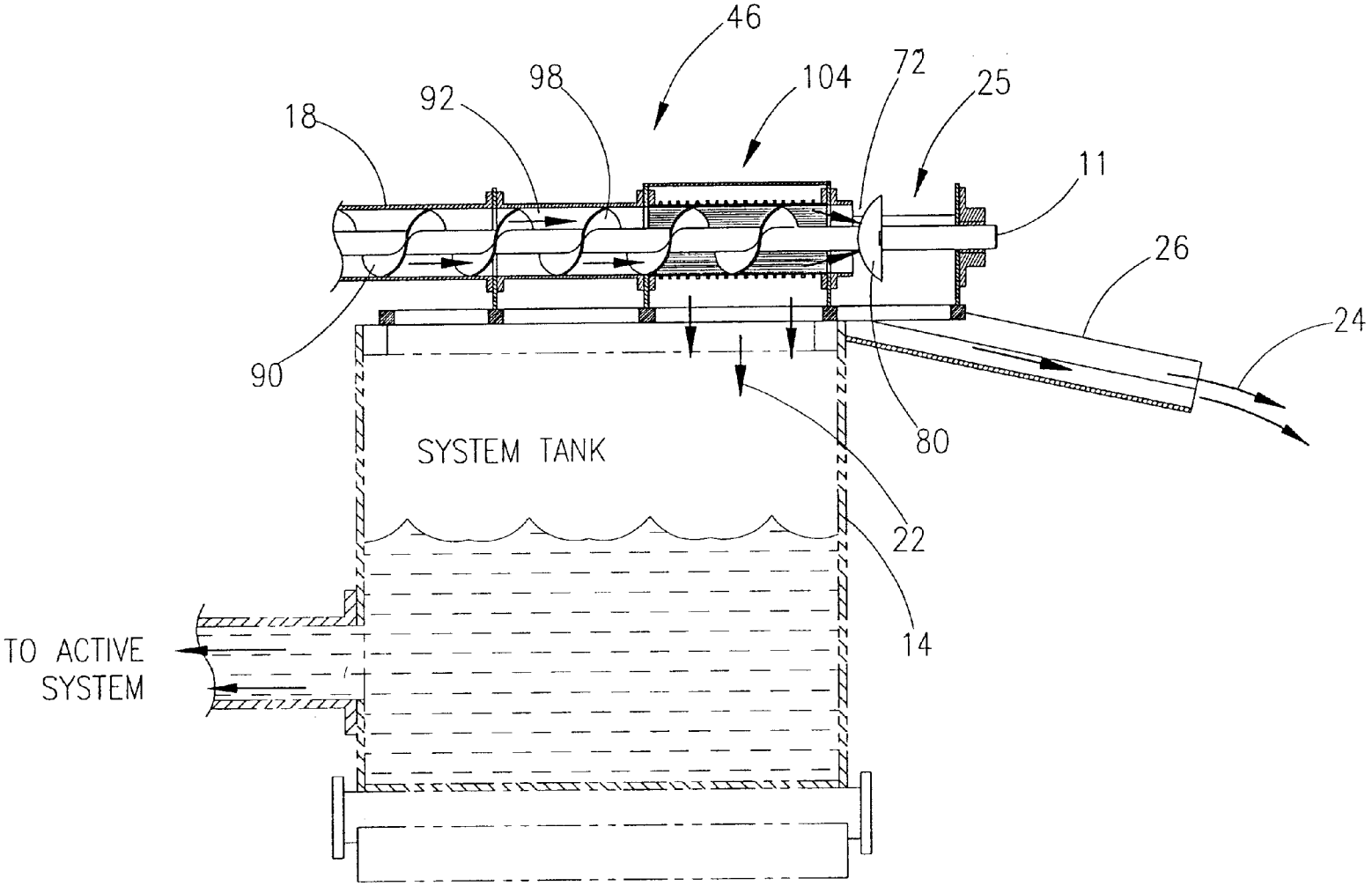
FIG. 3 is a partial cross section view of a system tank and the present invention mounted thereto, showing an infeed screw conveyor coupled directly to the feed screw of the present invention.

Referring first to FIG. 1 where the major components of the defluidization recovery system 10 starts with drill cuttings and drilling fluids in a slurry 16 collected from any source as overflow or underflow, usually from the rig's shaker screens (not shown). The slurry 16 is transported via a conveyor 18 to the screw press 20, shown here in cross section and better seen in FIG. 2, mounted on top of a fluid recovery tank 14, illustrating the flow path of the slurry 16 being defluidized. It is conceived that a screw press 20 or other compaction type presses depicted herein, having particular characteristics, could be mounted on or near a drilling fluids system tank 14 in which case drilling fluids contained in the overflow and underflow slurry 16 could be separated from the drill cuttings processing system prior to discharge into the environment. The slurry 16, in most cases, contains valuable drilling additives including synthetics and/or surfactants which, after having passed through a wash system (not shown), could be fed via a screw conveyor 18 to the press 20 where the slurry 16 is defluidized. The cuttings, contained in the slurry 16, when compacted in the press 20, as a result of being forced through a compaction zone 25, forces the drilling fluids 22, which containing valuable drilling additives, to be discharged into the system tank 14 for recirculation in the drilling process. The separated defluidized cuttings residue 24 is then discharged via a discharge chute 26 to a drill cuttings injection system 28, to a cutting storage box 30, or to a transporting vehicle 32 for transport to a hazardous waste site for injection in a deep well 34, or treated for environmental disposal at a land reclamation farm 36. The slurry 16 may be conveyed to the press 20 in any accepted manner, such as screw conveyor 18, gravity feed, or by pump. However, in most cases this is done by gravity feed or screw conveyors 18, in which case the slurry 16 is discharged into a hopper 38 attached to the press 20 infeed portion as seen in FIG. 2. Such screw conveyors 18 may also be coupled directly to a screw press 46 infeed screw as seen in FIG. 3, thereby eliminating the need for a separate drive mechanism 42 as shown in FIG. 2. Any liquid overflow in the hopper 38 passes through the overflow pipe 44 attached to the hopper 38 shown in FIG. 4 and enters the system tank 14. As indicated above, other types of presses may also be employed, such as the piston press 41 shown in FIG. 7. However, it should be understood that alternate means for injecting materials directly into the screw press may be employed by simply closing the infeed hopper as illustrated in FIG. 10, substituting an infeed device such as a Moyno type pump. Such an arrangement further increases the press's efficiency especially when a low solids to liquid ratio is present. Still another embodiment of the piston press can also be seen in FIG. 8 and 9, whereby a dual piston pump 50 is utilized which provides a means for drawing the slurry 16 being supplied to the hopper 52 into the ram tube 54 as a result of retraction of an internal piston 56, shown in FIG. 9 attached to the hydraulic ram cylinder 58 adjacent the ram tube 54. Valves 60, 60' located below the hopper 52 open alternately to allow the slurry to pass to each ram tube 54, 54' via valve 62. When the internal ram piston 56 is fully withdrawn an operating system reverses the piston 56 travel, whereby the valve 60 located below the hopper 52 is then closed simultaneously with valves 62' being opened at the entrance to the ram tube 54', juxtaposed the ram tube 54, being filled, and sequentially opening the discharge valve 63 located between the discharge merging element 66 and the press screen 74, the piston 56 then moves forward in the first cylinder 54, thereby expelling the slurry 16, while additional slurry material 16 is being taken into the second tube 54' by hydraulic ram cylinder 581 and piston 56' (not shown). The slurry 16 being expelled by each ram tube 54, 54' in turn is then forced into the 30 merging connector 66. A solids discharge zone at the end of the discharge tube 70 is essentially the same for all the presses disclosed herein. Restriction cylinders 68 are controlled remotely, thereby establishing the opening 72 between conical plug 80 and seat 82 thus providing compaction of the solids residue 24. The slurry 16, under pressure from the ram piston, 56 forces the slurry 16 linearly through a strainer screen 74. As a result of compaction in the discharge tube 70, fluids less than 50 micron are expelled through a screen sieve 74. The expunged fluid 22 is then returned to the system tank 14 while the more dense solids residue 24 greater than 50 micron is forced through the discharge tube 70. The system then reverses the operation for the alternate ram cylinder 58', thus creating a push pull operation. Therefore, while one ram cylinder 54 is filling, the adjacent cylinder 54' is being discharged. The solids residue 24 being forced through the discharge tube 70 is thereby extruded at a steady rate, controlled by the gap 72 between the elliptical plug 80 and its seat 82. The length of the discharge tube 70 and ambient temperature further enhance compaction, thus further reducing the moisture content of the discharge material 24.

Figure 4:
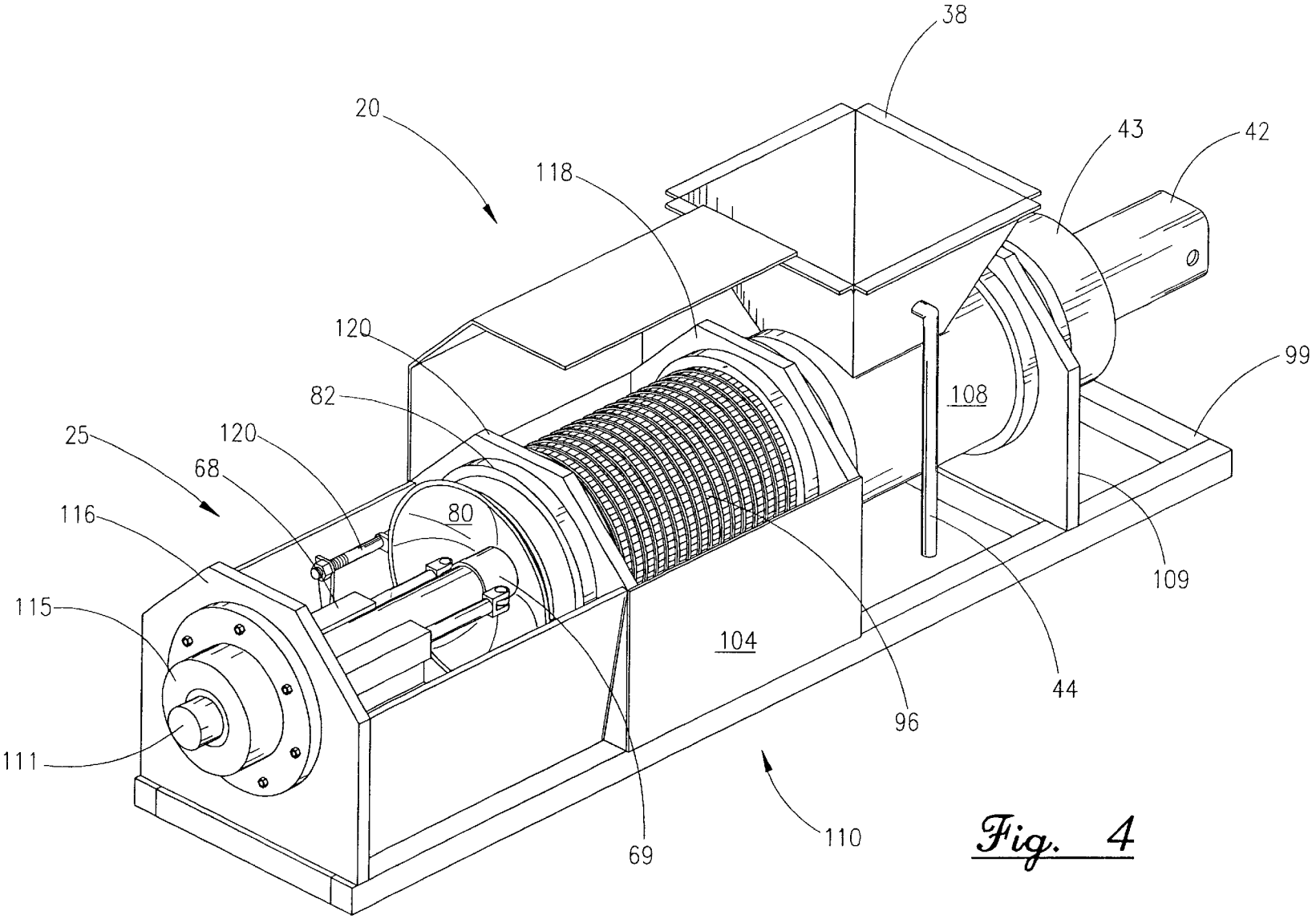
FIG. 4 is a an isometric view of the present invention.
Figure 6:
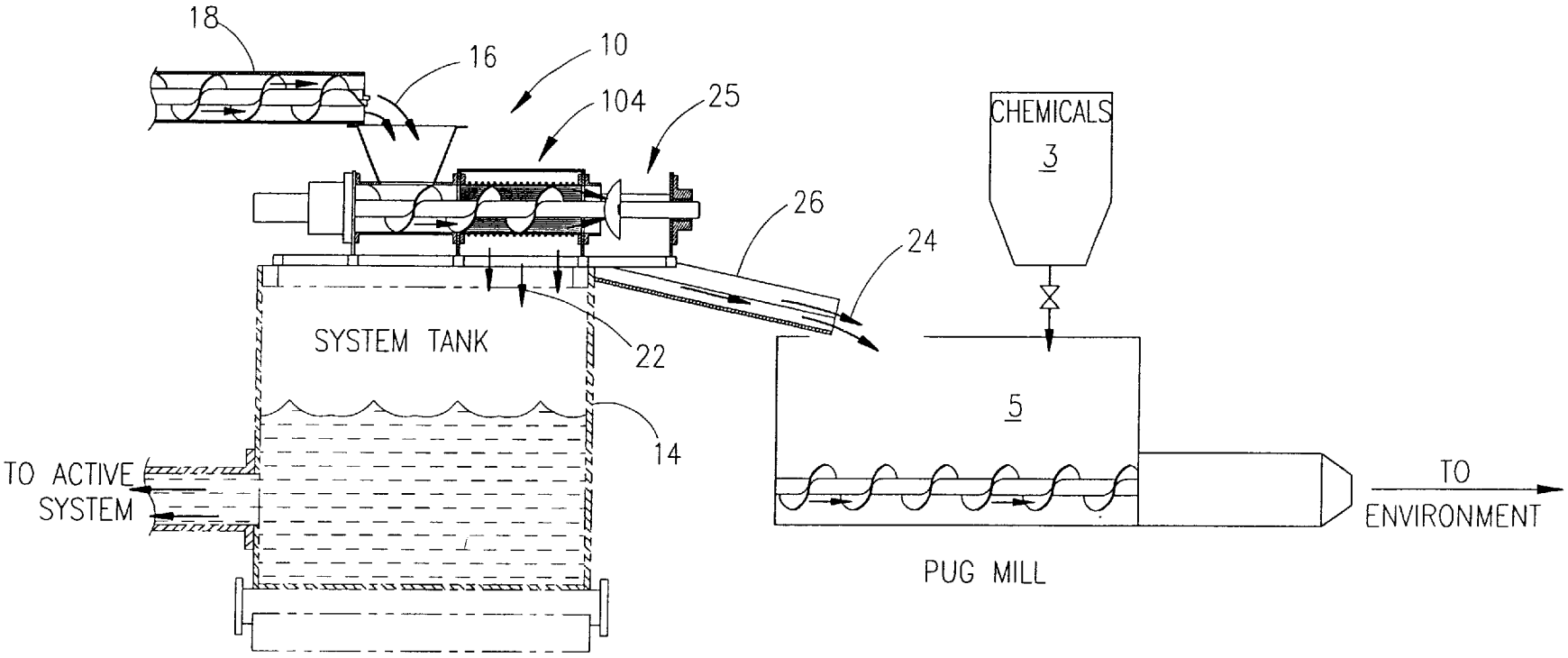
FIG. 6 is a cross section elevation showing the present invention discharging into a pug mill having chemical infeed capability.

The screw press 20 assembly as shown in FIG. 4 provides a better understanding of the requirement of a defluidizing press when applied to drilling fluid slurry 16 The slurry 16 is seldom consistent with respect to its volume or its density and, therefore, a positive means of controlling the restriction plug 80 is essential. Drilling fluid slurry 16 may vary in its consistency and at times may contain as little as 10% solids. Screw presses 20 have a tendency to become static when insufficient solids are present. Other press types and embodiments are disclosed herein which are capable of solving these problems. If a screw press 20 is used, it must have a more positive means of sealing between the screw flighting 90 and the cylindrical walls 92 as seen in FIG. 3. It is also imperative that the orifices 96 shown in FIG. 11 in the screen 94 be kept open. This may be accomplished by bonding a flexible material 98 to the flighting or constructing the screw from a polymeric material which allows for constant contact between the screw flighting 90 and the cylinder wall 92. Other methods of reducing static conditions and/or cavitation are shown in FIG. 10, wherein a valve 100 is applied between the infeed hopper 38 and the feed screen 74 and a vacuum line 101 and valve 102 are connected to the defluidizing zone 104. This negative pressure increases flow and insures a positive flow of recovered fluid 22 through the defluidizing screens 74. A positive pressure may also be used to increase flow through the defluidizing zone 104 through the use of air nozzles 106 located in the inflow zone 108. It is further anticipated that a chemical, such as calcium carbonate, can he added to the slurry inflow zone from a chemical tank 110 controlled remotely by a feed valve 112, thereby enhancing the defluidization process. As seen in FIG. 6, a screw press 20 may also he used in conjunction with a pug mill 5, whereby chemicals 3 such as lime and fly ash are mixed with the solid cuttings residue 24 prior to discharge into the environment. As best seen in FIG. 4 press 20, as well as in other section presses 40, 41 and 46, depicted in 9, 7 and 3 respectively, restriction in the compaction zone 25 of the discharge portion is effected in most cases by a pair of cylinders 68 disposed parallel either side the linear axis of the discharge flange 82. The cylinders 68 are adjusted remotely to position the conical restriction member 80 relative to the discharge flange 82, thereby providing infinite positive control of the discharge of defluidized material 24. The compacted solids 24 have a natural tendency to adhere to the inside diameter of the screen 74. It has been found that a relatively small vibrator 140 can be placed on the outer diameter of the screen in the manner illustrated in FIG. 12, thus imparting a vibration over the face of the screen eliminating much of the material adhesion.

Figure 11:
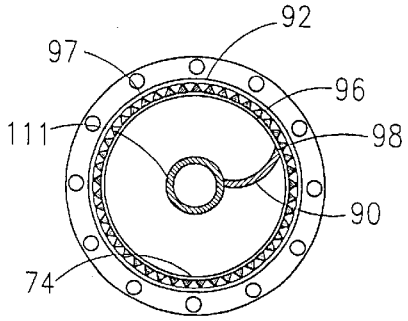
FIG. 11 is a partial cross section of the screen element.
Figure 12:
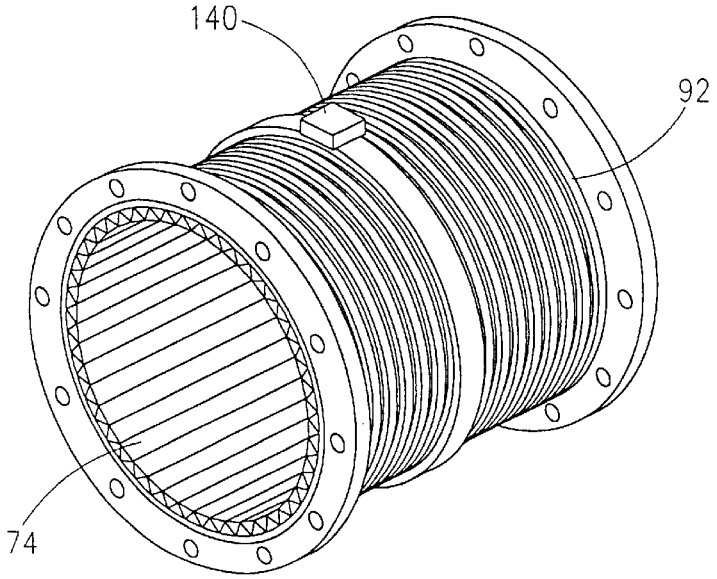
FIG. 12 is an illustration of a vibrator and band assembly located around the sieve screen.
Figure 13:
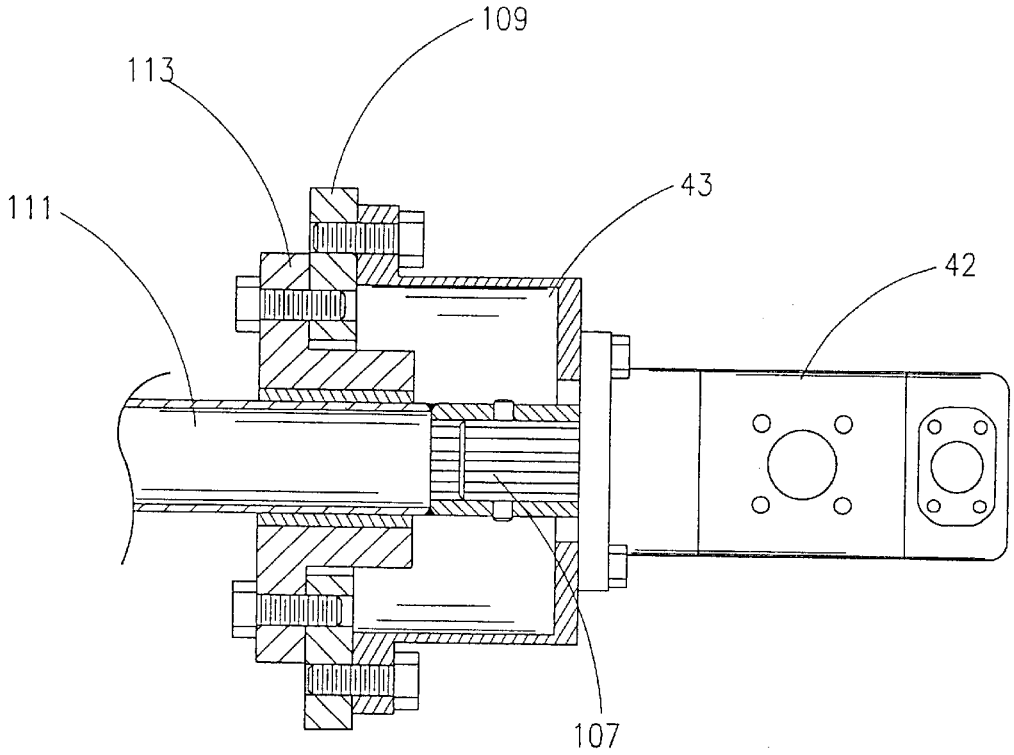
FIG. 13 is a partial cross section view of the drive motor mounted to the screw shaft.

As seen in FIG. 4 the screw press 20 is divided into three zones, 30: The infeed zone comprising a hopper 38 having an overflow tube 44, the hopper 38 located above and adjacent to the screw infeed compartment 108, a defluidizing zone 104, a fluid discharge 22 as illustrated in FIG. 2 and 3, and a solids discharge zone 25. The slurry 16, containing solids and drilling additives to be separated, is conveyed to the infeed hopper 38 and thus to the screw press 20 where any excess fluid is vented off through the overflow pipe 44. Most of the fluids in the slurry 16 are drained off through the separator strainers 74 in the defluidizing zone 104 prior to compaction. Compaction as a result of the solids being forced through the opening 72 between the restriction plug 80 the seat 82 in the compaction zone 25 by the press screw flights 90, forces any remaining liquids 22 having a diameter smaller than 50 micron from the slurry 16 via sieve screen 74. As seen in FIG. 4 the typical screw press of the present invention comprises a base frame 99 having vertical supports 109, 116, 118, and 120 extending upwardly therefrom; an infeed zone comprised of a hopper portion 38 mounted to a tubular infeed housing 108, having a flange fitting at each end, one end of which is supported inboard to vertical support 109 with the opposite end attached to one side of support 118. The press further comprises a driver motor 42 mounted to the external flange housing 43, shown in FIG. 4, secured to the outboard side of the vertical support 109 adjacent the infeed housing 108. As seen in FIG. 13 the drive motor shaft 107 is coupled directly to an output shaft 111, extending through the external flange housing 43, and held in axial alignment by a head shaft bearing 113 located within the external flange housing 43. The hollow screw shaft 111 is fitted with an internal spine which engages the drive motor output shaft 107. Shaft 111 fitted with helical screw flighting 90, shown in cross section in FIG. 11, is provided beginning in the infeed housing 108 and extending axially through the defluidizing zone 110 ending just short of the discharge flange 82 at support 116. The shaft 111 is rotatably supported by a flange bearing 115 mounted to vertical support 116.

The press further comprises a defluidizing zone 110 adjacent to the infeed zone, separator strainers 74, a collection chamber 104 surrounding the strainers, and a fluid discharge aperture 114 below the strainer passing through the base frame 99. The separator strainer or sieve screen 74 as illustrated in FIG. 11 comprises a 50 micron screen 94 backed by a plurality of wedged shaped, axially extending, parallel slats 97 held in an equally spaced, circumferential relationship by multiple supporting rings 93, slats 97 having a spacing between their widest portion of precisely 0.004 of an inch for 50 micron separators used for most drilling fluid recovery systems, with larger spacing used for greater micron screening for primary or special applications. Slats are formed into a radial diameter coinciding with the inside diameter of the infeed housing. flanges corresponding to the infeed housing discharge flange are secured to each end of the wedged shaped slats, thereby defining a flanged tubular section. At least three torsion members secured to and extending axially between the flanges are attached to each of the supporting rings, providing a ridged, structural unit. Any number of these strainer sections may be connected together and utilized as necessary to provide sufficient separation of the entrained solids. The strainer flange adjacent the discharge is secured to a vertical frame member 118 having a diametrical bore equal to the flange inside diameter.

The screw press further comprises a discharge zone comprising a flanged reducing tubular portion 82 having an internal diameter less than an internal diameter of the strainer screen sieve 74, the reducing flange 82 being mounted to the discharge side of the base frame, vertical support ember 120 adjacent the defluidization zone 110, a conical disk 80, slidable along the screw shaft 111, operated by a pair of ram cylinders 68 connected to a collar 69 at the back side of the conical disk.

Figure 7:
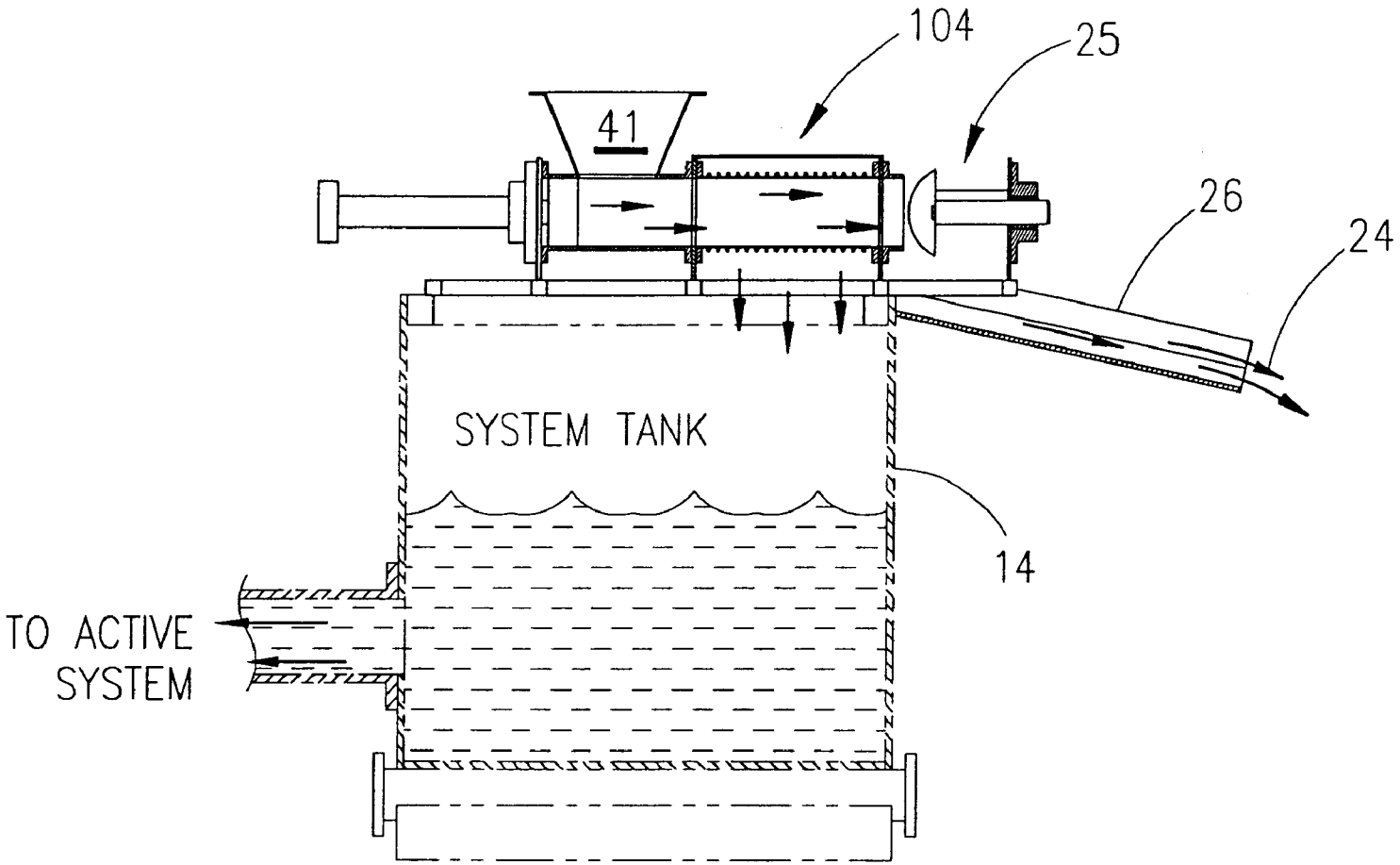
FIG. 7 is a cross section elevation of a second embodiment of the press having hydraulic ram feed.
Figure 8:
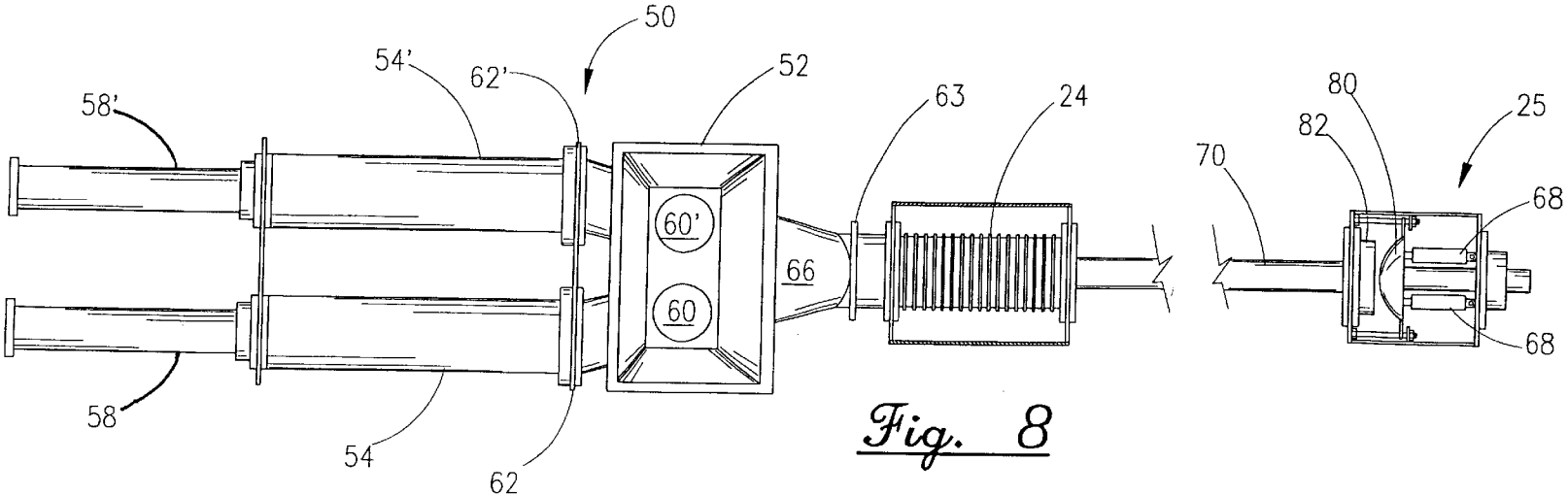
FIG. 8 is a plan view of a third embodiment showing a piston pump having defluidizing capability.
Figure 9:
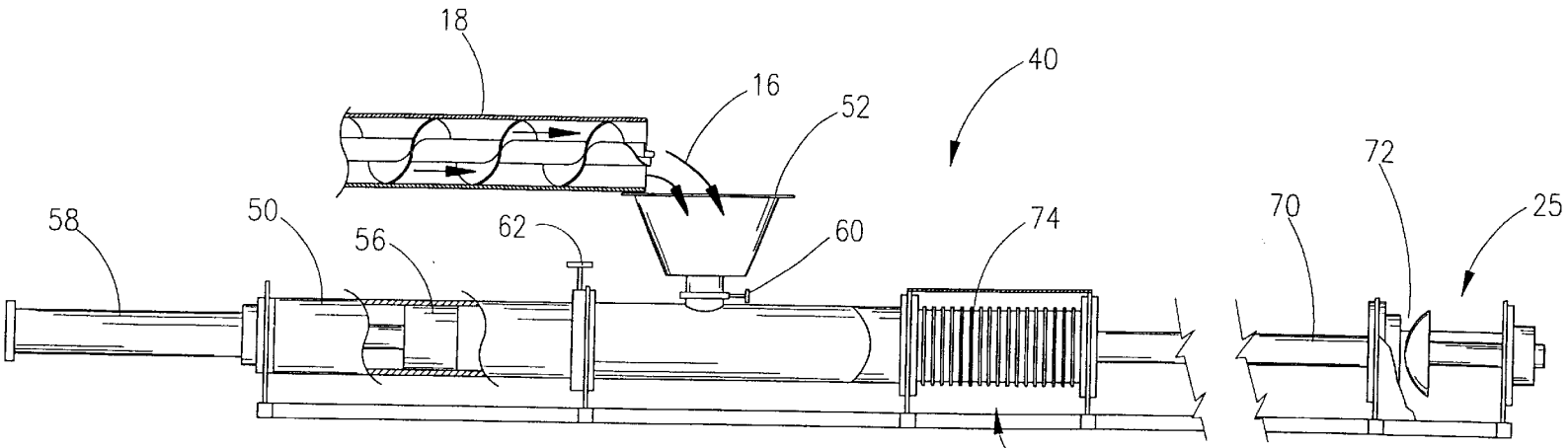
FIG. 9 is a side elevation of the piston pump in FIG. 8.
Figure 10:
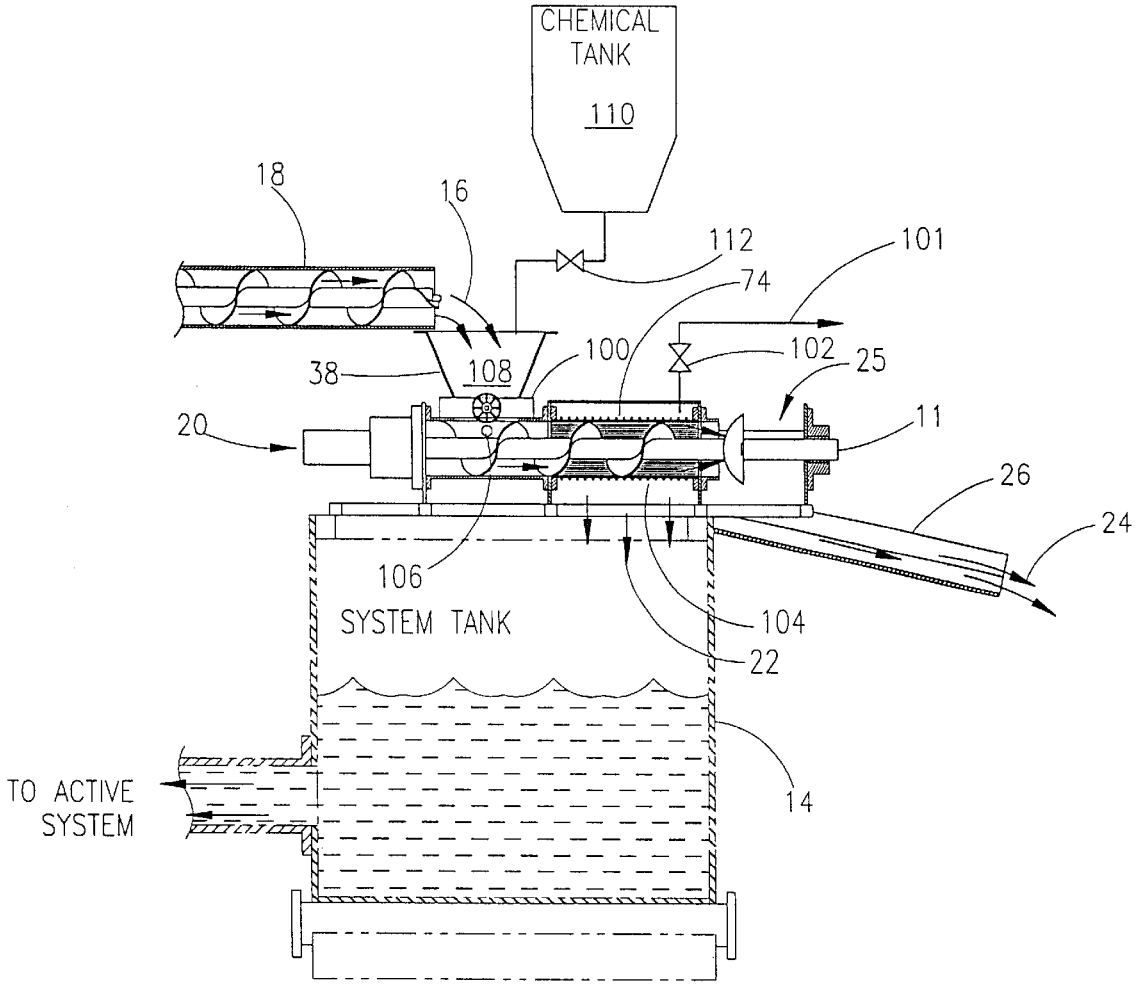
FIG. 10 is a side elevation and cross section of a screw press having means for applying pressure or vacuum to the defluidizing means.

The screw press 20 may be driven by a drive motor 42 by direct coupling to the infeed conveyor 18 as seen in FIG. 3, or by pistons as illustrated in FIGS. 7, 8, and 9. In any case the slurry 16 is urged through the defluidizing zone 110 towards the discharge zone 25. In cases utilizing rotating screw flighting 90, such flighting ends just short of the restriction element 80, as does the piston stroke. The elliptical restriction element 80 is slidable and rotatably fitted over the hollow feed screw shaft 111, thereby allowing the restriction element 80 to be positioned at various positions adjacent the discharge flange 82, such positioning being controlled by positioning cylinders 68 disposed on each side of the extension shaft 111 and attached to the elliptical restriction element 80. The positioning cylinders may be controlled remotely or manually adjusted. Rotation of the restriction element 80 is prevented relative to the rotating screw shaft 111 by torque arresters 121. With the restriction element 80 positioned in close proximity to the discharge flange 82, the discharge of the semi-dry drill cuttings 24 can be innitely controlled. In this manner, the solids from the slurry 16 are compacted, thereby forcing a significant amount of the remaining fluids 22 through the screens 74. The defluidization zone 110 defining an enclosure 104 surrounding the screen 74, enhances the ability of the press 20 to remove fluids rapidly. It has been found that a screen sieve 74 having a 50 micron admissibility is sufficient to recover most drilling additives in the slurry 16. It has also been found that a residue 24 moisture content of less than 40% can be achieved. It has also been found that a primary press of this nature can remove 40% by volume of the oil or water in a slurry 16 directed from the rig's cuttings shaker system, thereby reducing the moisture content of the discharge material 24 to as little as 13.4% liquid by weight.

Figure 5:
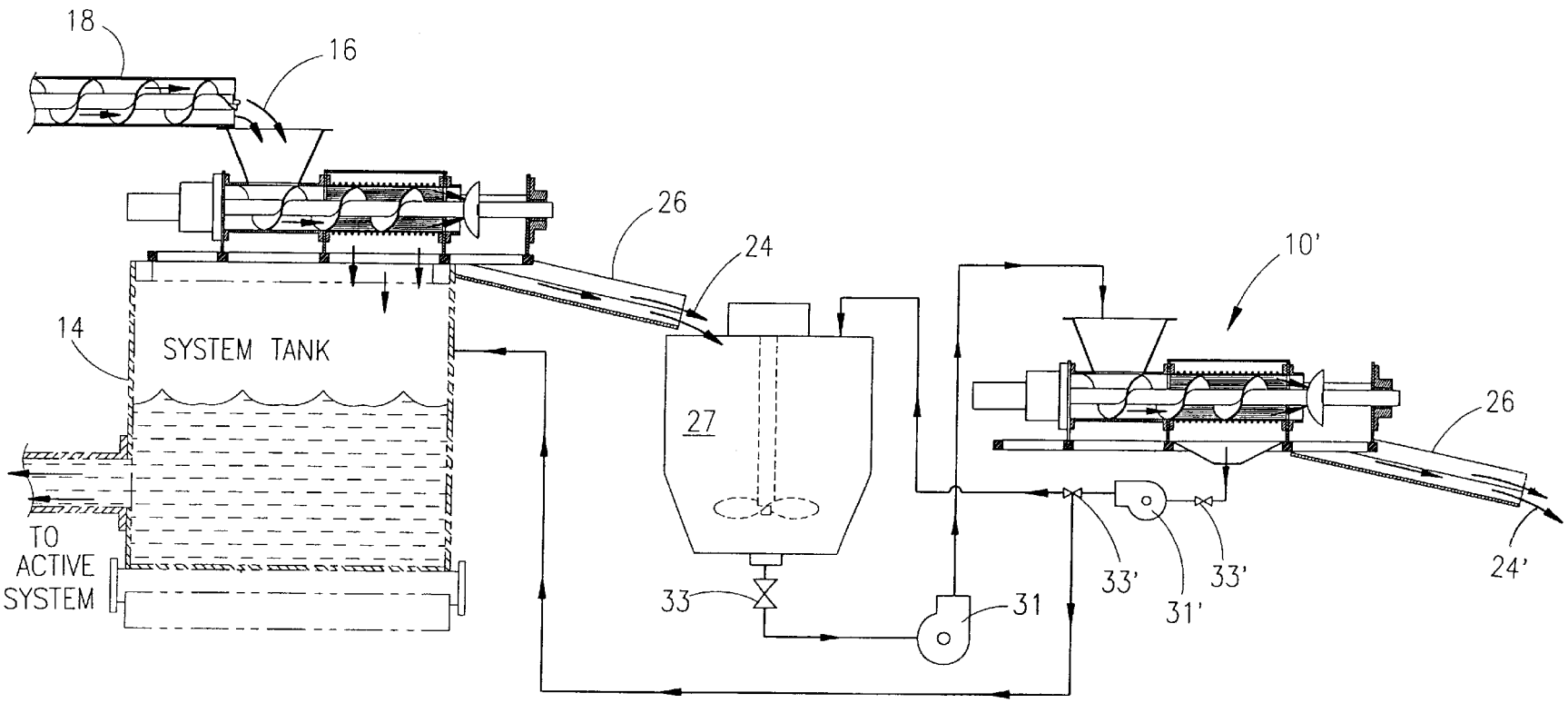
FIG. 5 is a cross sectional elevation and piping diagram of a two press system utilizing a circulating tank.

A second stage press 10' operation as illustrated by FIG. 5 could reduce the liquid content of the disposable cuttings 24 to less than 10% by wt. However, as illustrated, a circulating tank 27 may be necessary to maintain the slurry in solution. A system of pumps 31, 31' and valves 33, 33' for moving the fluids from the recirculating tank to the second stage press and from the second stage press back to the recirculating tank or system tank may also be needed.

Figure 14:
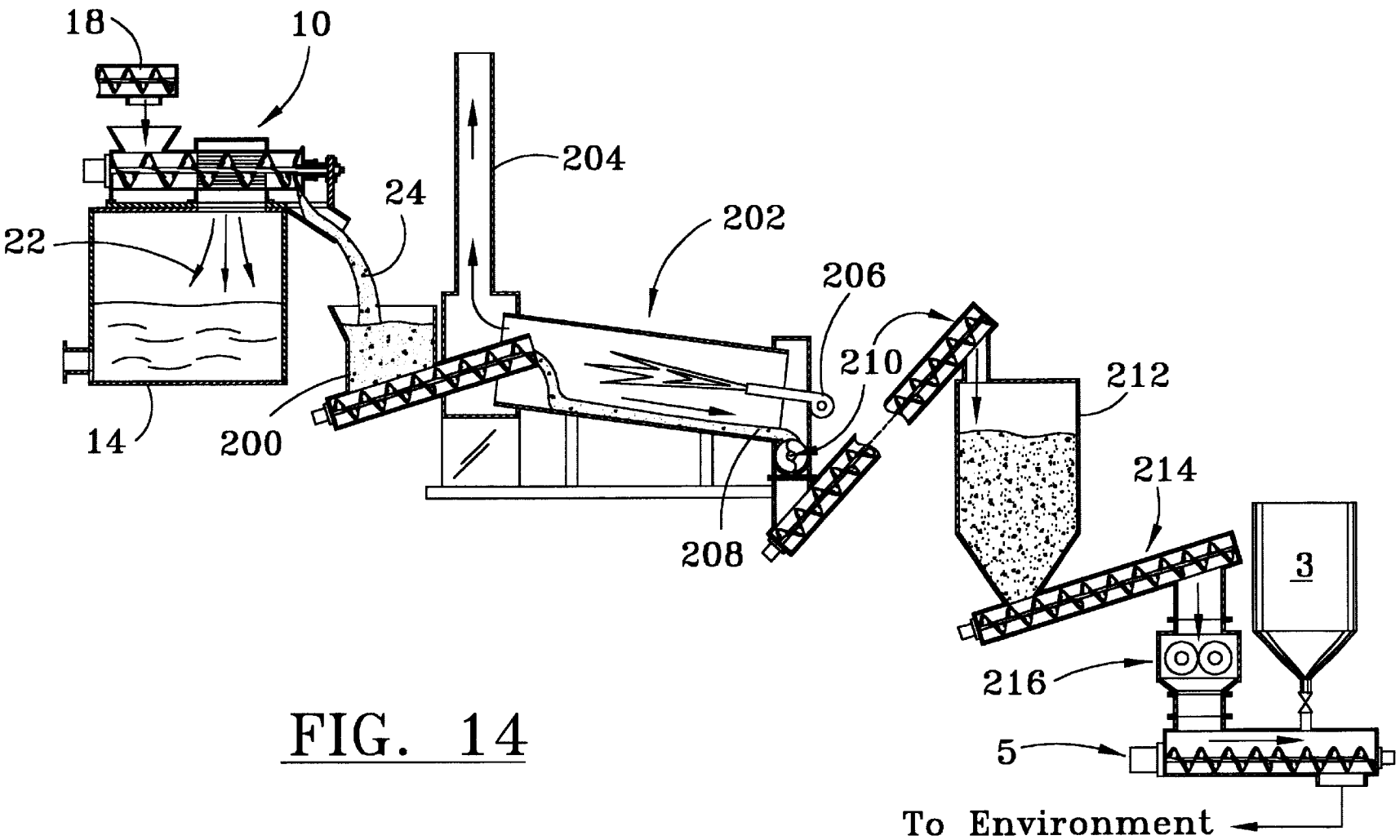
FIG. 14 is a vertical cross section view illustrating a cuttings drying system utilizing the disclosed technology.
Figure 15:
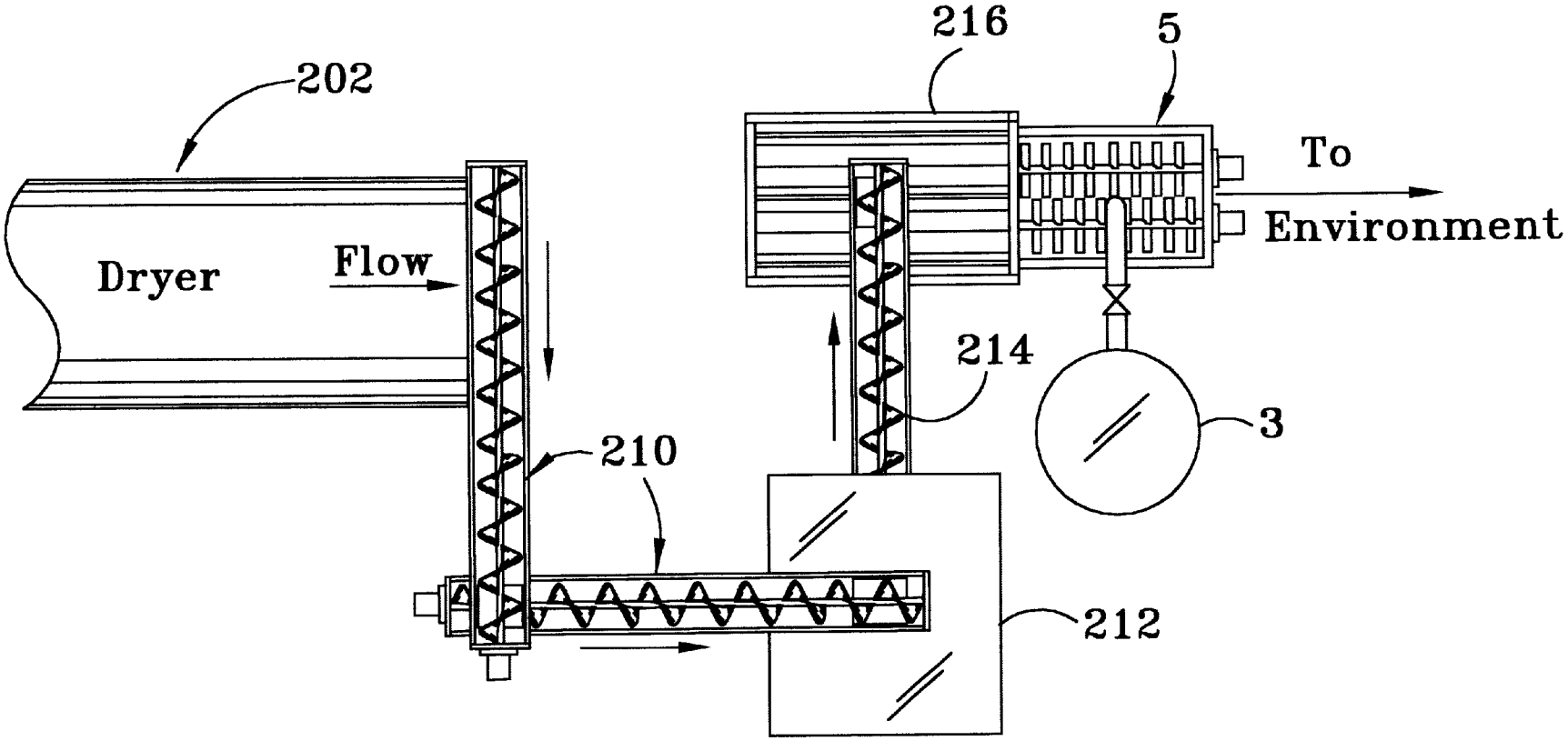
FIG. 15 is a partial top view of the system illustrated FIG. 14.
Figure 16:
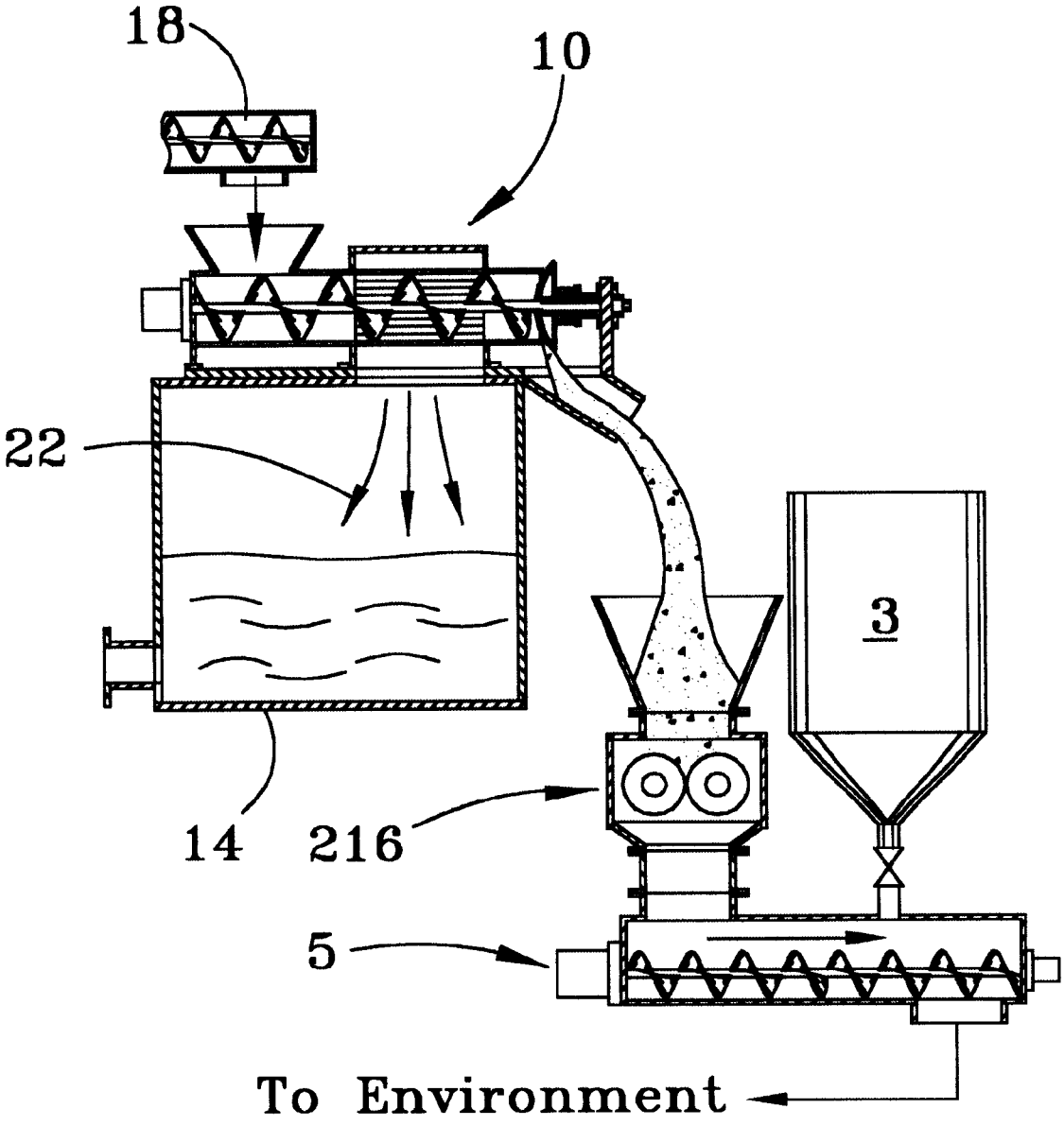
FIG. 16 is a vertical cross section of an alternative system utilizing the disclosed technology.

As seen in FIG. 14 it is contemplated that the semidry cuttings 24 being discharged from the press 10 may also be further processed by feeding the cuttings to the feed bin 200 of a rotary kiln 202. Where the petrochemical coated cuttings are fed into the kiln and ignited, the petrochemicals are driven off in vapors through the exhaust stack, recycled to the burner 206, or otherwise environmentally controlled as known within the art. The dried and sterile cutting solids are then moved by conveyer 210 to a collection container for deposit into one or more of the collection and transport or distribution means illustrated in FIG. 1 or conveyed to a holding hopper 212 where the cutting are held and metered by conveyer 214 or other such metering means to a high volume fine grinder such as a mill or pulverizer prior to depositing the fines in the mixing mill 5 illustrated earlier in FIG. 6, where lime and fly ash and the like are mixed with the solids prior to transport and distribution at a land fill. A plan view of the flow path is best seen in FIG. 15. As shown in FIG. 16, the semidry solids 24 may also be deposited directly into the fine grinder and the mixing mill 5 without drying the solids, in which case the fine solids are then combined with slurry additives which enhance flow of the solids for injection back into the earth formations through the high-pressure injection pump system 28 seen in FIG. 1

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A process for recovery of drilling fluid additives and cleaning surfactant from a slurry of drill cuttings discharge from a separation and recovery process comprising the steps of:

a) introducing said slurry into a defluidizing press comprising;

i) a housing including an inlet for receiving a drill cuttings slurry;

ii) a cylindrical strainer extending forwardly from said housing, said strainer having apertures for passage of fluids being separated from said cutting slurry and a vibrator for assisting in separation of said fluids from said cutting slurry;

iii) a reducing flange extending forwardly from an outlet end of said strainer and defining a solids discharge opening at a terminal end thereof, an internal diameter of said reducing flange being less than an internal diameter of said strainer;

iv) a press screw member disposed in a space defined by said housing and said cylindrical strainer, said press screw member including a shaft and a screw affixed to an outer periphery of said shaft, said screw beginning in said housing at a location rearwardly of said strainer and terminating within said strainer, said shaft extending forwardly beyond said reducing flange;

v) a motor for driving said press screw member thus advancing said slurry forwardly within said space and through said discharge opening, whereby entrained solids are separated from said fluids by compaction at a controlled rate;

vi) a conical mouth piece, slidable and rotatable relative to said screw, fixed to said shaft for effecting closure of said reducing flange; and vii) means for slidably positioning said mouth piece relative to said reducing flange;

b) compacting said slurry;

c) separating and removing entrained drilling fluid additives and solids up to 50 microns from said slurry;

d) returning said drilling fluid additives of 50 micron or less to a drilling fluids recirculating system; and e) discharging any solids of 50 micron or more for further defluidization and sterilization in a rotary kiln.

2. A process for recovery of drilling fluid additives and cleaning surfactant from a slurry of drill cuttings discharge from a separation and recovery process comprising the steps of:

a) introducing said slurry into a defluidizing press comprising;

i) a housing including an inlet for receiving a slurry;

ii) a cylindrical strainer extending forwardly from said housing, said strainer having a vibrator and apertures for passage of separated fluids;

iii) a reducing flange extending forwardly from an outlet end of said strainer and defining a solids discharge opening at a terminal end thereof, an internal diameter of said reducing flange being less than an internal diameter of said strainer;

iv) a press screw member disposed in a space defined by said housing and said cylindrical strainer, said press screw member including a shaft and a screw affixed to an outer periphery of said shaft, said screw beginning in said housing at a location rearwardly of said strainer and terminating within said strainer, said shaft extending forwardly beyond said reducing flange;

v) a motor for driving said press screw member thus advancing said slurry forwardly within said space and through said discharge opening, whereby entrained solids are separated from said fluids by compaction at a controlled rate;

vi) a conical mouth piece, slidable and rotatable relative to said screw, fixed to said shaft for effecting closure of said reducing flange; and vii) means for slidably positioning said mouth piece relative to said reducing flange;

b) compacting said slurry;

c) separating and removing entrained drilling fluid additives and solids up to 50 microns from said slurry;

d) returning said drilling fluid additives of 50 micron or less to a drilling fluids recirculating system;

e) discharging any solids of 50 micron or more into a fine grinder for further sizing and processing prior to deposition to environment deposite sites.

f) discharging said solids from said fine grinder into a mixing mill; said mixing mill having chemical additive means for introducing chemicals for mixing flow enhancing chemicals with said solids prior to introduction to a formation injection system.

3. A process for recovery of drilling fluid additives and cleaning surfactant from a slurry of drill cuttings discharge from a separation and recovery process comprising the steps of:

a) introducing said slurry into a defluidizing press comprising;

i) a housing including an inlet for receiving a slurry;

ii) a cylindrical strainer extending forwardly from said housing, said strainer having a vibrator and apertures for passage of separated fluids;

iii) a reducing flange extending forwardly from an outlet end of said strainer and defining a solids discharge opening at a terminal end thereof, an internal diameter of said reducing flange being less than an internal diameter of said strainer;

iv) a press screw member disposed in a space defined by said housing and said cylindrical strainer, said press screw member including a shaft and a screw affixed to an outer periphery of said shaft, said screw beginning in said housing at a location rearwardly of said strainer and terminating within said strainer, said shaft extending forwardly beyond said reducing flange;

v) a motor for driving said press screw member thus advancing said slurry forwardly within said space and through said discharge opening, whereby entrained solids are separated from said fluids by compaction at a controlled rate;

vi) a conical mouth piece, slidable and rotatable relative to said screw, fixed to said shaft for effecting closure of said reducing flange; and vii) means for slidably positioning said mouth piece relative to said reducing flange;

b) compacting said slurry;

c) vibrating said strainer and separating entrained drilling fluid additives and solids up to 50 microns from said slurry by passing through said strainer;

d) returning said drilling fluid additives of 50 micron or less to a drilling fluids recirculating system;

e) discharging any solids of 50 micron or more for further defluidization and sterilization in a rotary kiln;

f) discharging sterilized dry solids from said kiln and transferring said dry solids to a fine grinding mill for further size reduction;

g) discharging said dry solids from said fine grinding mill into a mixing mill; said mixing mill having chemical additive means for introducing chemicals for mixing environmental enhancing chemicals with said dry solids prior to transport to environmental deposit sites.

* * * * *